US005555970A

United States Patent [19]

Coccolo

[11] Patent Number: 5,555,970

[45] Date of Patent: Sep. 17, 1996

[54] DEVICE FOR THE QUICK CHANGE OF TRACKS

[75] Inventor: Enzo Coccolo, Gorizia, Italy

[73] Assignees: Danieli & C. Officine Meccaniche SpA, Buttrio; Danieli Centro Maskin SpA, Pradamano, both of Italy

[21] Appl. No.: 299,635

[22] Filed: Sep. 2, 1994

[30] Foreign Application Priority Data

Sep. 21, 1993 [IT] Italy ..... UD93A0190

[51] Int. Cl.[6] ..... B65B 35/00

[52] U.S. Cl. ..... 198/866; 226/200; 414/590; 414/664; 483/22

[58] Field of Search ..... 198/626.1–626.6, 198/346.1, 866; 226/200; 414/589, 590 X, 664 X; 29/33 P; 483/22, 26, 36,38–43, 48, 51

[56] References Cited

U.S. PATENT DOCUMENTS 4,558,506 12/1985 Kielma ..... 29/33 P
4,985,971 1/1991 Kitamura ..... 29/33 P

FOREIGN PATENT DOCUMENTS 548723 12/1992 European Pat. Off. ..... B21C 1/30
2238538 11/1973 France ..... B21C 1/30

*Primary Examiner*—Joseph E. Valenza
*Attorney, Agent, or Firm*—Antonelli, Terry, Stout & Kraus

[57] ABSTRACT

Device for the quick change of tracks, which is suitable to cooperate with a traction unit (12) of a type with two facing tracks (11) such as that of EP-A-548723, for instance, and comprises a movable trolley (13), which has in a position substantially at the front of the traction unit (12) a first withdrawal and delivery position (13*a*), a second replacement position (13*b*) and an intermediate rotation position (13*c*) for pre-arrangement of the new set of tracks (111).

3 Claims, 2 Drawing Sheets

DEVICE FOR THE QUICK CHANGE OF TRACKS

BACKGROUND OF THE INVENTION

This invention concerns a device for the quick change of tracks.

The device for the quick change of tracks according to the invention is employed to replace the upper and/or lower tracks respectively of a traction unit associated with a drawing machine.

This replacement of the tracks is necessary both for maintenance and also whenever the section to be drawn is changed, inasmuch as the outer surface of the links forming the tracks has a shape that mates with the form of the section to be drawn.

EP-A-548723 discloses a system to feed drawn bars which consists of a traction unit comprising a pair of facing tracks.

Each track includes an endless catenary of links.

The links have their engagement surface mating with the shape of the section to be drawn.

At the present time the replacement of the tracks of the traction unit is carried out by a plurality of workers with a series of long, tiring and also dangerous operations.

To be more exact, after the track to be replaced has been disengaged from the traction unit, that track is withdrawn by using a hoist or another known lifting system and is replaced by another track, which too is handled with the same system.

These changes of tracks therefore entail a series of long, burdensome, complex and also dangerous operations since tracks are being handled which have a great weight.

Moreover these operations require long replacement times during which the drawing machine has to stay still, and therefore lower the output of the whole system.

SUMMARY OF THE INVENTION

The present applicants have designed, tested and embodied this invention to overcome the shortcomings of the state of the art and to achieve further advantages.

The purpose of the invention is to provide a device for the quick change of tracks associated with a traction unit of a drawing machine.

The device for the quick change of tracks according to the invention enables the tracks to be replaced in a quick and safe manner and reduces the downtimes of the drawing machine considerably and therefore increases the output.

The quick change device according to the invention requires the attendance of only one machine operator for its actuation and needs no physical effort by that operator.

The device for the quick change of tracks comprises a movable trolley including a turntable with a vertical axis, upon which are fitted the means which withdraw the tracks.

The movable trolley can move from a first withdrawal and delivery position distant from, and substantially at the front of, the traction unit, at which position are performed the operations of delivery of the old track and of positioning on the movable trolley the new track to be fitted, to a second replacement position, at which the trolley faces the traction unit of the drawing machine at the position of the tracks.

The movable trolley has also an intermediate position for its rotation so as to pre-arrange the new track and orient that track towards the traction unit.

The means that withdraw the tracks include attachment means which keep the tracks in position when the tracks have been withdrawn.

The withdrawal means in the withdrawal device according to the invention are advantageously two in number and are installed symmetrically in positions diametrically opposite to each other on the turntable so as to make possible in an immediate sequence the withdrawal of the old track to be replaced from the traction unit and the delivery of the new track to be fitted to the traction unit by means of a simple rotation of the turntable.

In the description that follows, the words "old tracks" mean the tracks already positioned on the traction unit and requiring replacement, while the words "new tracks" mean the tracks which have to be fitted to the traction unit to replace the "old tracks". In a first form of embodiment the withdrawal means are associated with vertical positioning means, which enable the withdrawal means to be positioned so as to coincide with the respective upper and lower tracks of the traction unit, according to requirements.

In a second form of embodiment the turntable includes upper and lower withdrawal means which are respectively arranged substantially on the same plane as the upper track and lower track fitted to the traction unit.

By means of this second form of embodiment of the device for the quick change of tracks according to the invention it is possible to carry out the simultaneous replacement of the upper track and lower track, thus reducing still further the replacement times and therefore the downtimes of the traction unit.

The withdrawal means include levelling and alignment means, which make possible a correct alignment with the respective track to be withdrawn or installed.

According to a variant the withdrawal means according to the invention include a clamping/release assembly, which cooperates with fixture means that secure the track to be withdrawn to the traction unit.

According to this variant, so as to facilitate the work of the withdrawing and recovering of the track by the withdrawal means of the track changing device according to the invention, the traction unit may include advantageously means to expel the track which has been released in a timely manner from the fixture means.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 1:
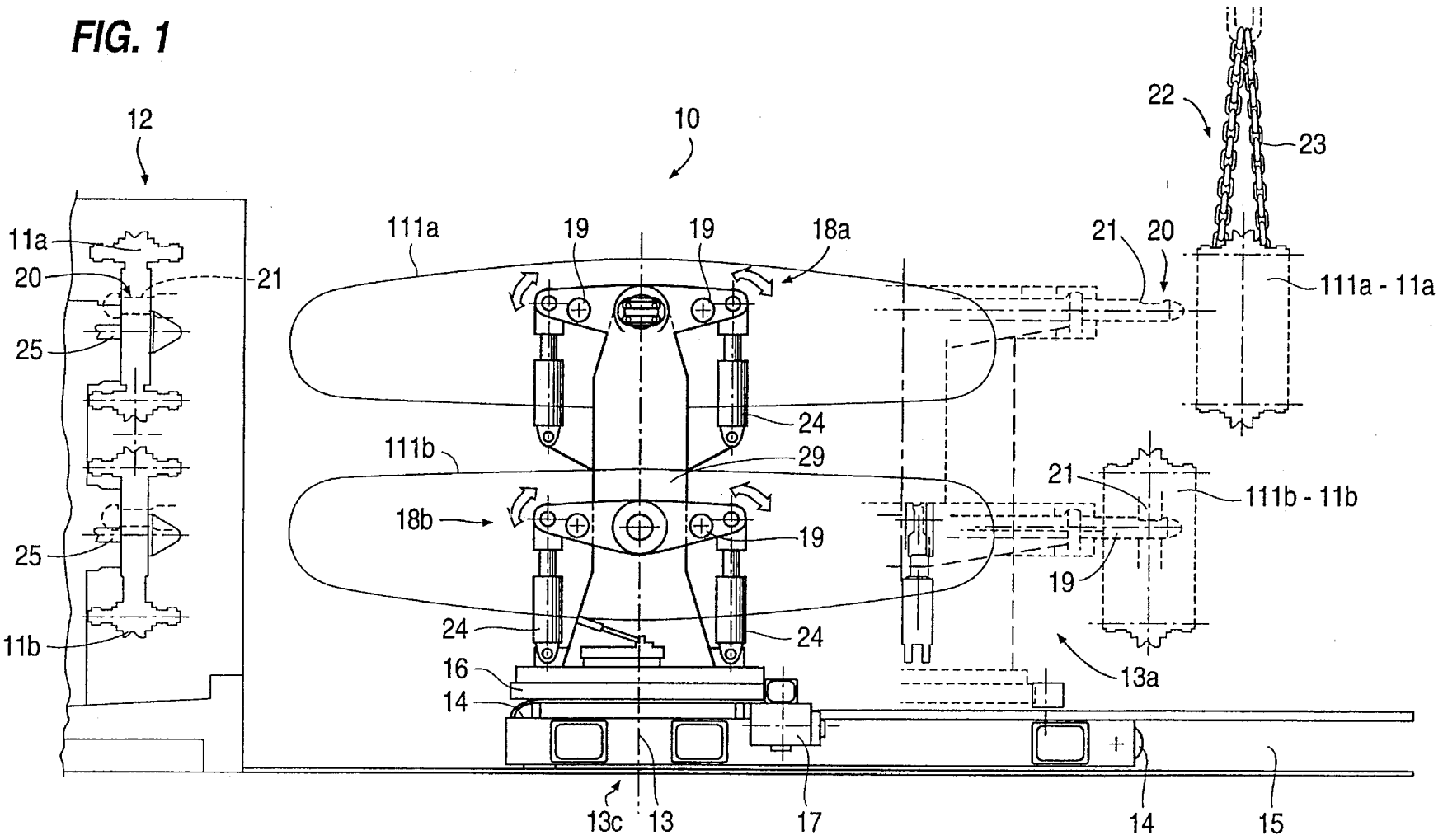
FIG. 1 is a side view of the track changing device according to the invention in association with a traction unit of a drawing machine.
Figure 2:
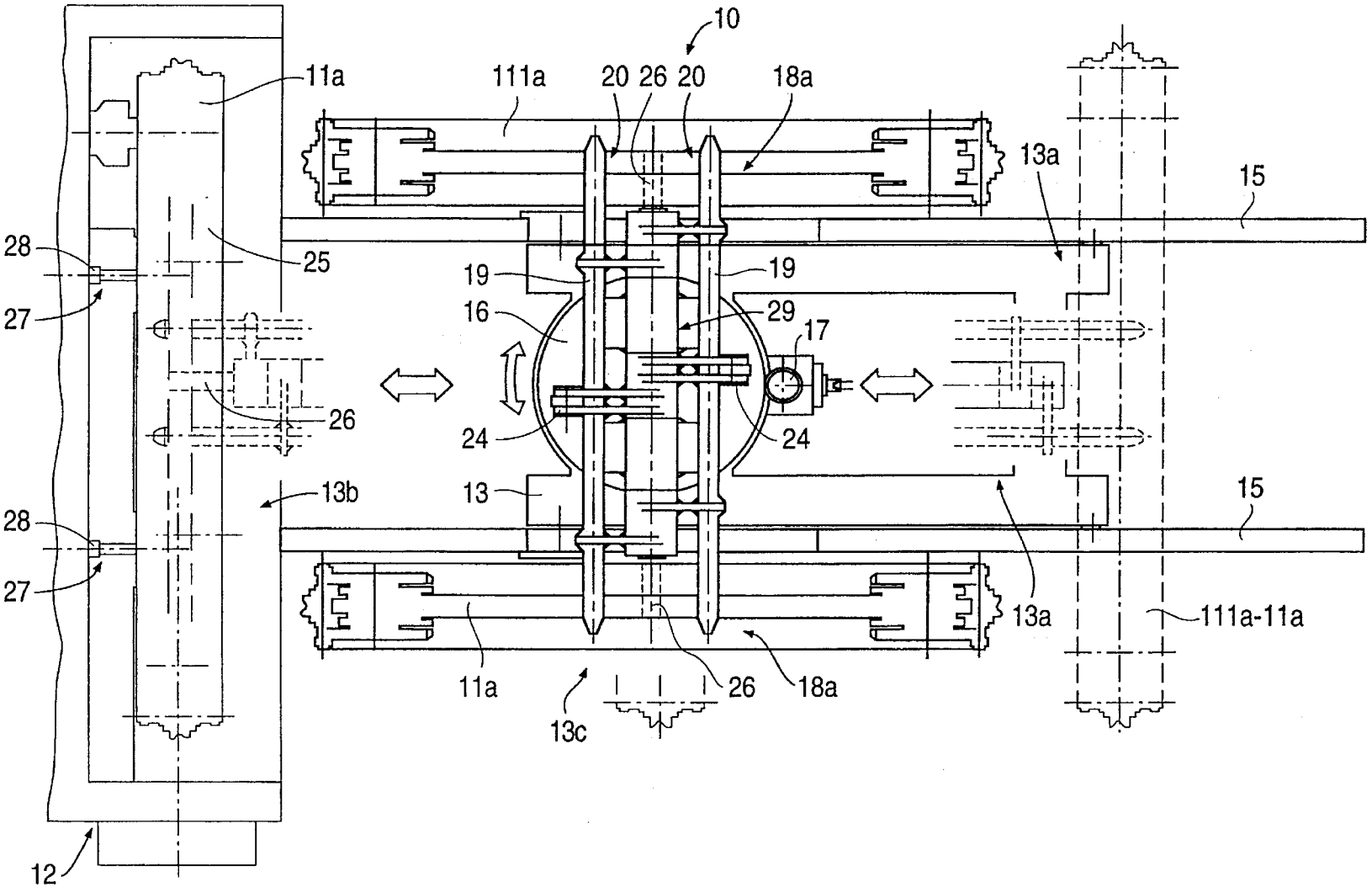
FIG. 2 is a plan view of the track changing device of FIG. 1 according to the invention.

The reference number 10 in the attached figures denotes generally a device for the quick change of tracks 11 according to the invention.

The track change device 10 according to the invention is employed in association with a traction unit 12, such as that disclosed in EP-A-548723 for instance, associated with a drawing machine of a known type, which has not been shown here as it is not relevant for the purposes of the invention.

The track change device 10 according to the invention enables at least one "old track" 11 to be withdrawn, whether it be an upper "old track" 11*a* or a lower "old track" 11*b*, from the traction unit 12 and to be replaced by a "new track" 111.

So as to simplify the description we shall use hereafter in the description the words "old track" 11 to mean the track 11 already present on the traction unit 12 and requiring replacement, whereas the words "new track" 111 shall mean the track 111 which has to be fitted to the traction unit 12 to replace the "old track" 11.

The track change device 10 according to the invention comprises a trolley 13 able to move from a first withdrawal and delivery position 13*a*, where it withdraws the new track 111, to a second replacement position 13*b*, where it cooperates with the traction unit 12 in the delivery and installation of the new track 111.

The movable trolley 13 in the withdrawal position 13*a* cooperates with a supporting means 22, which holds in position the new track 111 to be withdrawn.

In this case the supporting means 22 comprises a chain 23 attached to a hoist of a known type, which is not shown here.

In this example the movable trolley 13 is installed on wheels 14 that run in guides 15, and is driven by a motor, which is not shown here.

A turntable 16 is fitted to the movable trolley 13 and is driven by a motor 17 able to rotate the turntable 16 step by step in at least one direction.

The movable trolley 13 has also an intermediate position 13*c* of rotation in which the turntable 16 is rotated by 180° to bring the new track 111 or new tracks 111*a* and 111*b* to the front of the traction unit 12.

In this case the turntable 16 includes two pairs of withdrawal means 18, namely upper withdrawal means 18*a* and lower withdrawal means 18*b* respectively.

The upper 18*a* and lower 18*b* withdrawal means are arranged respectively so as to coincide substantially with the median horizontal plane of positioning of the upper old track 11a and with the median horizontal plane of positioning of the lower old track 11*b*.

According to a variant the turntable 16 comprises only one pair of vertically movable withdrawal means 18, which can be positioned vertically according to the track 11 to be replaced, whether that track be the upper track 11*a* or the lower track 11*b*.

In this case the withdrawal means 18 consist of a pair of parallel withdrawal bars 19 lying substantially on one and the same horizontal plane and comprising terminal positioning and retention means 20, with which the tracks 11-111 cooperate momentarily.

In this example the positioning and retention means 20 consist of a notch 21 machined in the upper surface of the withdrawal bars 19; the track 11-111 cooperates with this notch 21 during the withdrawal step.

In this case the retention means 20 are included at both ends of the withdrawal bars 19 and thus enable the operations of withdrawal of the upper 11*a* and/or lower 11*b* old tracks and of delivery and installation of the upper 111*a* and/or lower 111*b* new tracks to be carried out with a rotation of 180° of the turntable 16.

The withdrawal bars 19 are fitted on one side and the other of a supporting and positioning element 29 which extends vertically and is solidly fixed on the same axis as and upon the turntable 16.

The withdrawal bars 19 cooperate with levelling means, which in this case consist of independent actuators 24, so as to make possible a correct alignment of the withdrawal bars 19, and therefore of the new tracks 111 momentarily associated with those bars 19, with drive and supporting shafts 25 of the traction unit 12.

According to a variant the turntable 16 comprises, in association with the upper 18*a* and lower 18*b* withdrawal means, release/clamping means 26, which cooperate momentarily with the fixture means of a screw-threaded type, for instance, which secure the track 11 to be withdrawn/delivered from/to the traction unit 12.

The same release/clamping means 26 cooperate with the fixture means clamping the new track 111 when the latter has been installed in position on the traction unit 12.

In this case the release/clamping means 26 are single and are placed in an intermediate position between the two withdrawal bars 19 so as to cooperate with the fixture means.

According to a variant the release/clamping means 26 are two in number and are arranged symmetrically outside the two withdrawal bars 19, the fixture means being positioned in a coordinated manner.

According to another variant expeller means 27 consisting of actuators 28 in this case are included on the traction unit 12 and, in cooperation with the track 11 released by the fixture means, facilitate the withdrawal of the track 11 by the withdrawal means 18.

I claim:

1. A combination of a traction unit having a pair of facing tracks for drawing sections therethrough and a device for changing tracks of the traction unit, the device for changing tracks comprising a movable trolley movable from a first position in cooperation with a support for a new track to be installed on the traction unit to a second position in cooperation with a traction unit for removing an old track from the traction unit and for installing a new track on the traction unit, the movable trolley being provided with a first withdrawal and delivery means for withdrawing a new track from the support and for delivering the new track to the traction unit and a second withdrawal and delivery means provided on the opposite side of the trolley as the first withdrawal and delivery means for withdrawing an old track from the traction unit, and means for rotating the trolley at least 180° about a vertical axis.

2. A combination as in claim 1, wherein the pair of facing tracks of the traction unit comprise an upper track having a median horizontal plane of positioning and a lower track having a median horizontal plane of positioning, and wherein each of said first and second withdrawal and delivery means comprise upper and lower withdrawal and delivery means provided substantially on the median horizontal plane of positioning of the upper and lower tracks, respectively, of the traction unit.

3. A combination as in claim 2, wherein each of the withdrawal and delivery means comprises a pair of bars provided substantially on a respective median horizontal plane of positioning of a track of the traction unit.

* * * * *